US012577960B2

(12) United States Patent
Sperber et al.

(10) Patent No.: US 12,577,960 B2
(45) Date of Patent: Mar. 17, 2026

(54) FLUID PUMP WITH EMBEDDED HEAT DISSIPATING PLATE

(71) Applicant: Valeo Powertrain GmbH, Ebern (DE)

(72) Inventors: Christian Sperber, Ebern (DE); Harry Steinmetz, Ebern (DE); Andy Mikusch, Ebern (DE); Dimitri Ostrohov, Ebern (DE); Marcel-Cornel Girbea, Ebern (DE)

(73) Assignee: Valeo Powertrain GmbH, Ebern (DE)

( * ) Notice: Subject to any disclaimer, the term of this patent is extended or adjusted under 35 U.S.C. 154(b) by 81 days.

(21) Appl. No.: 18/539,930

(22) Filed: Dec. 14, 2023

(65) Prior Publication Data

US 2024/0200615 A1 Jun. 20, 2024

(30) Foreign Application Priority Data

Dec. 15, 2022 (DE) ..... 10 2022 133 528.3

(51) Int. Cl.
*F04D 29/58* (2006.01)
*F04C 15/00* (2006.01)
*F04C 29/04* (2006.01)

(52) U.S. Cl.
CPC ..... *F04D 29/5893* (2013.01); *F04C 15/008* (2013.01); *F04C 15/0096* (2013.01);
(Continued)

(58) Field of Classification Search
CPC ..... F04D 29/5893; F04D 29/5806; F04D 29/5813; F04D 29/5853; F04D 13/0606; F04C 15/008; F04C 15/0096; F04C 29/047; F04C 2240/30; F04C 29/04; F04C 29/0085; F04C 15/0057
See application file for complete search history.

(56) References Cited

U.S. PATENT DOCUMENTS

2007/0177993 A1* 8/2007 Nakamichi ..... F04D 13/0673 417/354
2008/0118380 A1* 5/2008 Nakanishi ..... F04D 29/5813 417/423.1
(Continued)

FOREIGN PATENT DOCUMENTS

DE 10 2012 207 675 A1 11/2013
DE 10 2019 130 719 A1 5/2021
(Continued)

OTHER PUBLICATIONS

German Search Report issued Aug. 3, 2023 in German Application 10 2022 133 528.3 filed on Dec. 15, 2022, 7 pages (with English Translation of Categories of Cited Documents & Written Opinion).
(Continued)

*Primary Examiner* — Bryan M Lettman
(74) *Attorney, Agent, or Firm* — Oblon, McClelland, Maier & Neustadt, L.L.P.

(57) ABSTRACT

A fluid pump, in particular an oil pump for supplying a clutch actuator, a gearbox actuator, a lubrication system and/or a cooling system of a drive train. The fluid pump includes a housing, a stator, a control unit which is arranged at one end of the housing, and a heat-conducting element with a plate-like base body. The stator, the control unit and the plate-like base body are embedded in a casting compound.

19 Claims, 4 Drawing Sheets

(52) U.S. Cl.
CPC ..... *F04C 29/047* (2013.01); *F04D 29/5806* (2013.01); *F04D 29/5813* (2013.01); *F04C 2240/30* (2013.01)

(56) References Cited

U.S. PATENT DOCUMENTS

| | | | | |
|---|---|---|---|---|
| 2020/0355187 | A1* | 11/2020 | Bao | F04D 29/5813 |
| 2021/0285455 | A1* | 9/2021 | Stoessel | F04B 49/06 |
| 2023/0407882 | A1* | 12/2023 | Awasare | F04D 29/5806 |
| 2024/0133377 | A1* | 4/2024 | Stoessel | F04C 15/0088 |

FOREIGN PATENT DOCUMENTS

| | | | |
|---|---|---|---|
| DE | 10 2019 130 722 | A1 | 5/2021 |
| JP | 2019-203389 | A | 11/2019 |
| WO | WO 2022/239484 | A1 | 11/2022 |

OTHER PUBLICATIONS

Extended European Search Report issued Apr. 29, 2024 in European Patent Application No. 23213751.3, 9 pages.

* cited by examiner

FLUID PUMP WITH EMBEDDED HEAT DISSIPATING PLATE

The invention relates to a fluid pump, in particular an oil pump for supplying a clutch actuator, a gearbox actuator, a lubrication system and/or a cooling system of a drive train, with an electric drive unit which comprises a stator and a rotor which is arranged inside the stator and can rotate about a rotor axis.

Such fluid pumps and methods are known from the prior art. An example can be found in DE 10 2019 130 722 A1. Such fluid pumps are often fitted in motor vehicles, in particular cars. The electric drive units of such fluid pumps are here usually controlled via control units provided inside the fluid pump.

Here, the fluid pumps must firstly function reliably in aggressive environments, i.e. environments with high temperatures and/or shaking or vibrations, over their entire useful life. Furthermore, it is desirable that the fluid pumps can be produced with the lowest possible cost. There is often a conflict of objectives here between low production costs, on one hand, and high reliability over a long period.

So that the fluid pump can be produced simply and at the same time functions reliably even under adverse environmental conditions over its entire useful life, it is known from the abovementioned document that the control unit and the stator are embedded in the drive housing by means of a casting compound. The whole housing is here filled with the casting compound. Relative movements between the stator, the control unit and the drive housing are prevented by the casting compound over the entire useful life of the fluid pump and the penetration of dirt, moisture, etc can also be prevented. The robustness is further increased by the rigid housing which is present in addition to the casting compound. The fluid pump consequently also functions reliably under adverse conditions. At the same time, the casting of the control unit and the stator is relatively simple such that the fluid pump can be produced simply and cost-effectively.

It has, however, been established that electronic power components which are part of the control unit generate a relatively large amount of waste heat under certain operating conditions. In terms of the useful life of the electronic components, it is desirable that this waste heat is reliably dissipated.

The object of the invention consists in providing a fluid pump in which the waste heat from electronic power components of the control unit can be dissipated reliably without a great deal of effort being required for this purpose.

In order to achieve this object, a fluid pump is provided according to the invention, in particular an oil pump for supplying a clutch actuator, a gearbox actuator, a lubrication system and/or a cooling system of a drive train, with a housing, a stator, a control unit which is arranged at one end of the housing, and a heat-conducting element with a plate-like base body, wherein the stator, the control unit and the plate-like base body are embedded in a casting compound. The invention is based on the fundamental concept of distributing the locally occurring waste heat over a larger surface area by means of the heat-conducting element such that it can then be emitted to the outside through the casting compound and no hot spots occur. It has namely proven to be the case that if the waste heat which occurs is distributed over a large surface area, the thermal conductivity of the casting compound is sufficient to dissipate quickly the waste heat which occurs such that the electronic power components cannot heat up to undesirably high temperatures. The particular advantage of the construction according to the invention consists in the fact that the whole of the plate-like base body is embedded inside the casting compound such that the front side of the cast body formed by the casting compound is designed as closed. A closed outer face of the cast body is particularly advantageous in terms of thermal expansion which occurs during operation in the case of temperature differences.

According to an embodiment of the invention, it is provided that the base body has a surface area which is more than 50% of the internal cross-section. As a result, it is ensured that the waste heat occurring at the control unit is dissipated over a large surface area. In principle, the base body should have a surface area which is as large as possible and preferably in the order of 80% or alternatively more than 90% of the internal cross-section. In order to make production simpler or when other components have to be arranged laterally next to the heat-conducting element, it can be necessary to design the base body with a slightly smaller surface area.

The base body can be provided with support tabs which bear elastically against the inner surface of the housing. Heat can be emitted directly to the housing of the fluid pump via the support tabs such that an additional "heat exchange surface" with the environment can be used here.

According to one embodiment, it is provided that the heat-conducting element and the housing are electrically conductive. As a result, the emission of electromagnetic radiation to the outside is reduced. Moreover, the effect of EMC radiation externally is reduced and the interference resistance improved. Better EMC compatibility results in this way. The materials from which the heat-conducting element and the housing are made are then not only optimized in terms of thermal conductivity but also in terms of electrical conductivity and hence in terms of the capacity to act as a shield for electromagnetic radiation in both directions. The housing and hence also the heat-conducting element are connected to each other capacitively or galvanically via a suitable connection depending on requirements with regard to EMC.

It is preferably provided that the base body bears directly against at least one electronic component of the control unit such that a direct transfer of heat is ensured.

It can alternatively also be provided that a thin layer of casting compound is situated between at least one electronic component of the control unit and the base body. It has been proven to be the case that such a thin layer of casting compound does not significantly impede the heat conductance because the conventional casting compounds have a thermal conductivity of a similar magnitude to that of heat-conducting pastes that are used to attach heat sinks to electronic components.

The base body can be provided with a plurality of spacers which bear against a printed circuit board of the control unit, wherein the spacers are designed in particular as beads. The spacers ensure that the heat-conducting element is situated in a precise position relative to the printed circuit board before the interior of the housing is filled with the casting compound.

The base body can be provided with a plurality of through openings such that material bridges are formed from the casting compound between those sections of the cast body which lie on opposite sides of the base body. This is advantageous with respect to the resulting strength of the cast body.

The base body can have at least one embossed raised/depressed portion which has a different spacing from the printed circuit board of the control unit than the remainder of the base body. By means of the raised/depressed portions which can, for example, be embossed, the height profile of the base body can be adapted to the different height of different electronic power components such that optimal heat dissipation into the base body is ensured for each power component.

The base body can be made of an aluminium alloy such that a high thermal conductivity with a low weight results. Alternative possible materials are steel, copper or brass. It is also conceivable to use a plastic that is a good conductor of heat.

The housing can be made of an aluminium alloy too, which is advantageous for the total weight of the fluid pump. Other materials, for example plastic, are, however, also suitable in principle. Depending on the requirements for the thermal conductivity, the latter can be optimized such that it has high thermal conductivity.

The invention will be described below on the basis of two embodiments which are illustrated in the appended drawings, in which.

Figure 1:
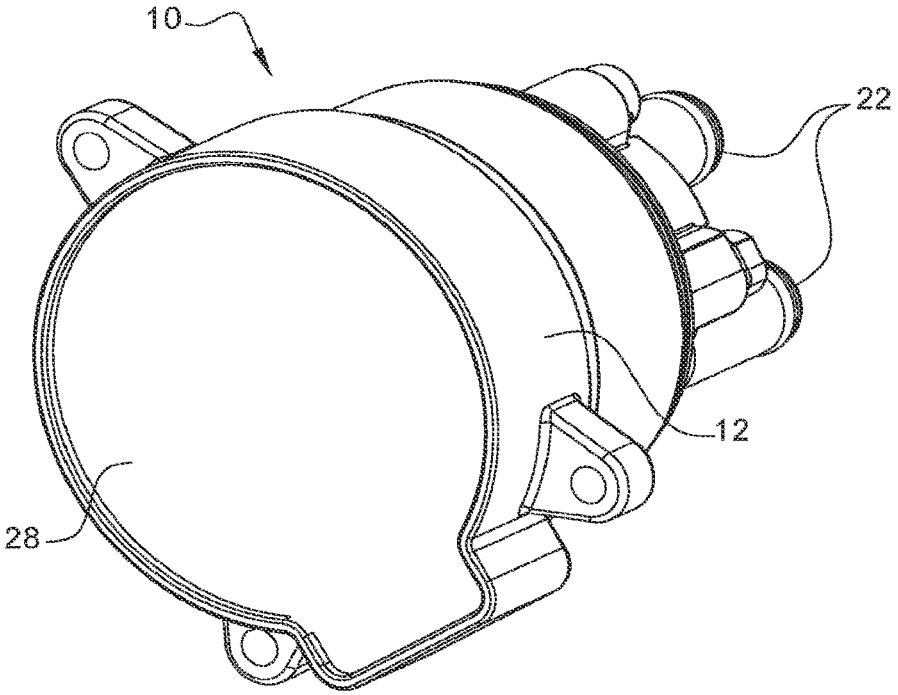
FIG. 1 shows a fluid pump according to the invention in a perspective view.

A fluid pump 10, which has a housing 12 in which a stator 14 (see FIG. 2) and a control unit 16 are arranged, is shown in FIG. 1. The control unit 16 is used to activate the stator such that a rotor 18 can be set in rotation in a desired fashion.

The rotor 18 is part of a pump module which has a pump unit 20, driven by the rotor 18, by means of which a fluid can be pumped through suction and pressure ports 22 shown schematically in FIG. 1.

The pump module with the pump unit 20 and the rotor 18 is attached to the housing 12 from outside such that the rotor 18 lies inside the stator 14.

A cap 24 which delimits the space relative to the rotor 18 is arranged inside the housing 12. The internal volume between the wall of the housing 12 and the cap 24 is filled with a casting compound 26. In addition to the stator 14 and the control unit 16, a heat-conducting element 30 is also embedded in the casting compound 26 and thus in the cast body 28 formed by the set casting compound 26.

Figure 5:
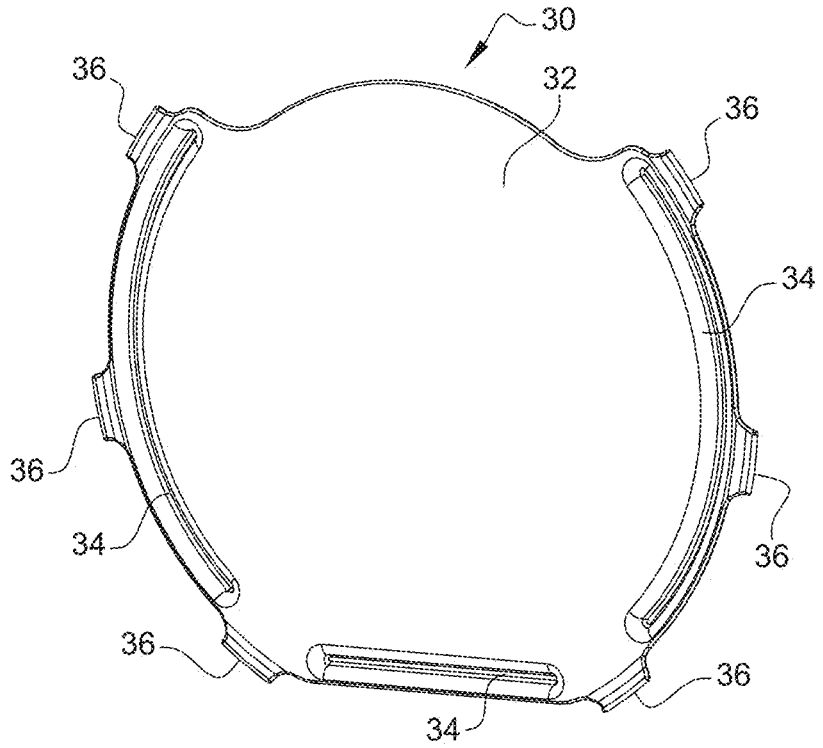
FIG. 5 shows a heat-conducting element of the fluid pump according to a first embodiment in a perspective view.

The heat-conducting element 30 (see in particular FIG. 5) has a plate-like base body 32 which is here designed as plane.

Provided in the vicinity of the outer rim of the base body 32 are a plurality of spacers 34 which are here designed in the form of beads which extend along almost the whole outer circumference of the base body.

The heat-conducting element 30 here extends over almost the whole cross-section of the housing 12.

Figure 2:
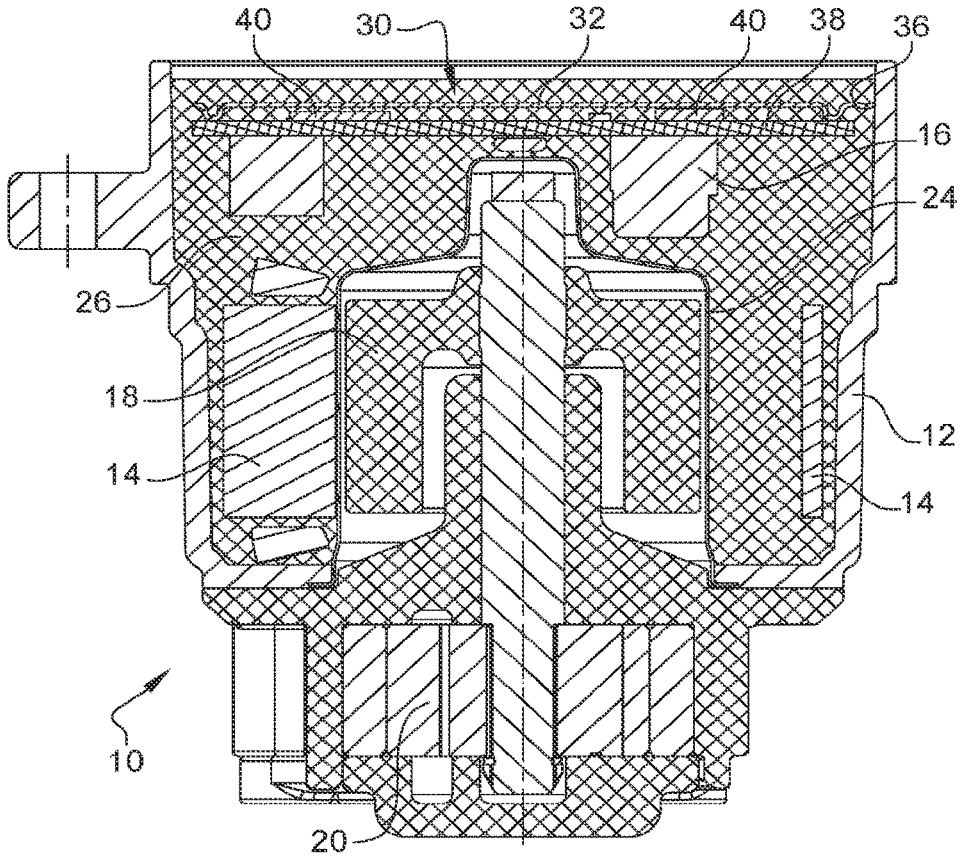
FIG. 2 shows a cross-section through the fluid pump from FIG. 1.
Figure 3:
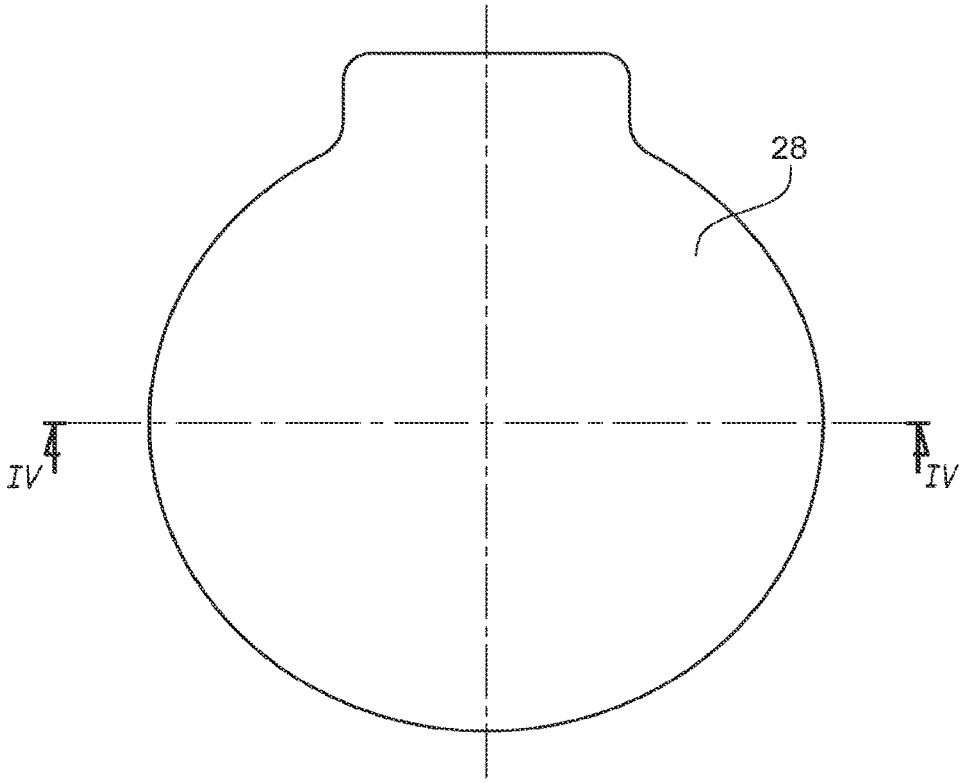
FIG. 3 shows a plan view of the cast body of the fluid pump in FIGS. 1 and 2.
Figure 4:
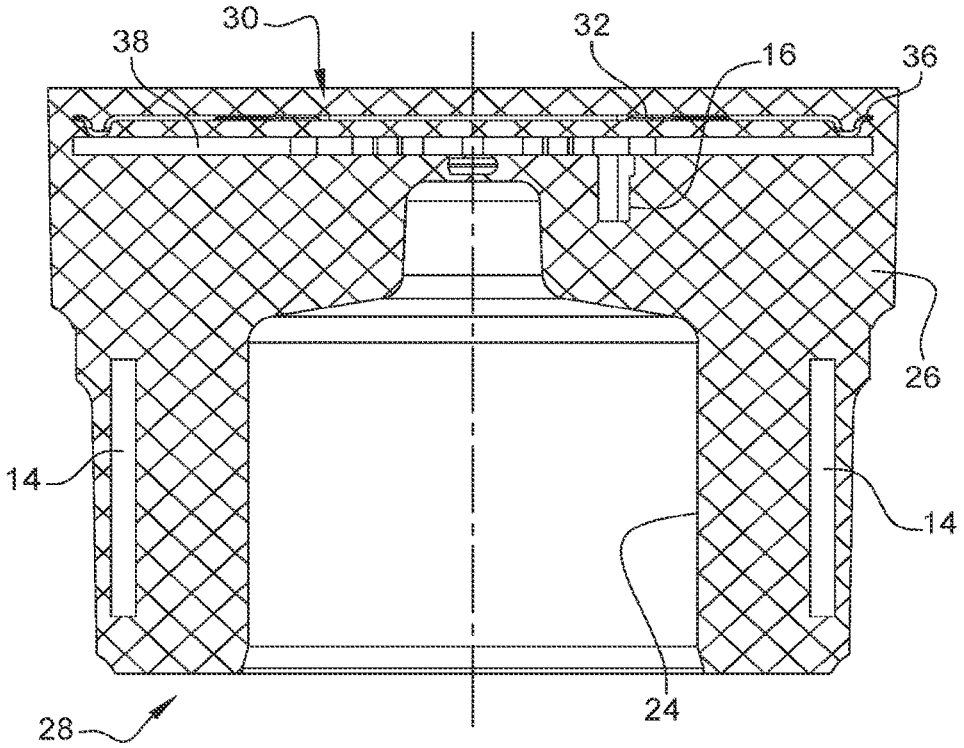
FIG. 4 shows a section along the plane IV-IV of FIG. 3.

Provided at the outer rim of the base body 32 of the heat-conducting element 30 are a plurality of support tabs 36 which are provided and dimensioned so as to bear against the inner side of the housing 12 under pretension (see FIG. 2).

The heat-conducting element 30 is attached to a printed circuit board 38 of the control unit 16 before the housing 12 is filled with the casting compound 26, and to be precise such that the spacers 34 are supported on the printed circuit board 38. It is consequently ensured that the base body 32 of the heat-conducting element 30 is situated with a desired predefined spacing from electronic power components 40 which are part of the control unit 16.

As can be seen in FIG. 2, the heat-conducting element 30 is arranged on that side of the printed circuit board 38 which faces away from the stator 14.

The support tabs 36 can be used to install the heat-conducting element 30 at the desired position inside the housing 12 and bearing against the printed circuit board 38 of the control unit 16. Depending on the component heights of the electronic power components 40 of the control unit 16 (and also depending on any raised/depressed portions which are embossed in the base body 32 of the heat-conducting element 30), the electronic power components 40 bear directly against the heat-conducting element 30 or a small gap is present between the upper side of the power components 40 and the underside of the base body 32 of the heat-conducting element 30.

If the interior of the housing 12 is filled with the casting compound 26, the space between the printed circuit board 38 and the heat-conducting element 30 is also filled. A quantity of casting compound 26 is added here such that the level of the casting compound is above the heat-conducting element 30 such that the latter is completely embedded. As can be seen in FIGS. 1 and 2, however, the heat-conducting element 30 is situated with a slight spacing below the end face of the cast body 28 thus formed.

Figure 6:
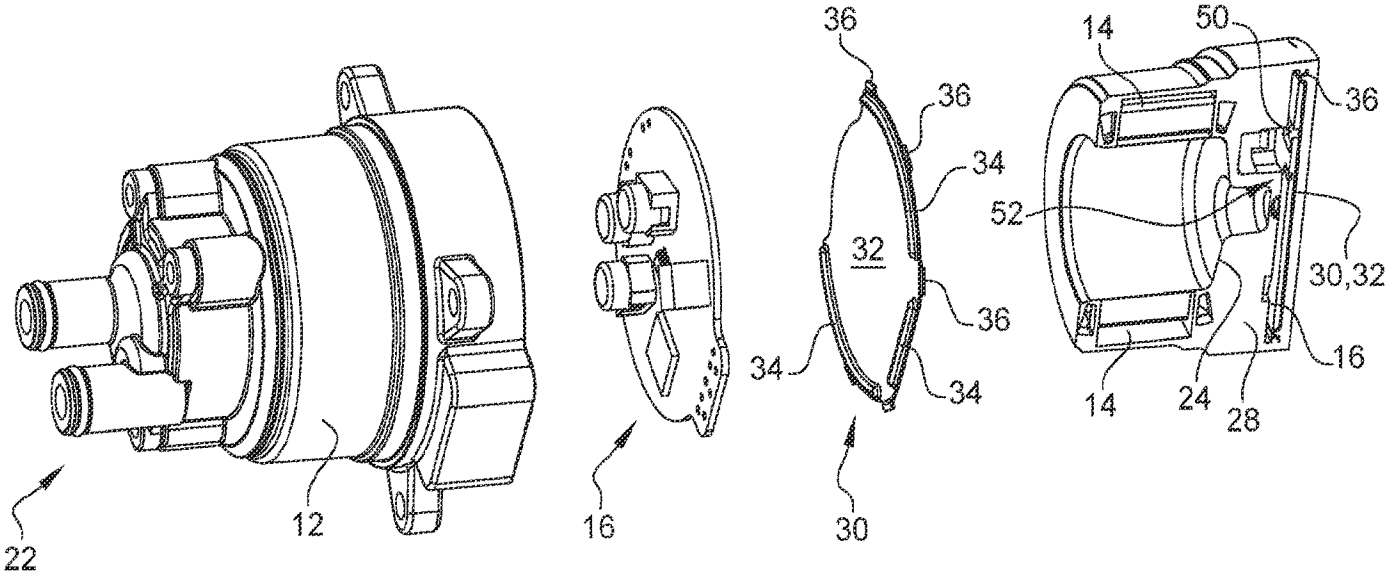
FIG. 6 shows a schematic exploded view of a fluid pump according to the first embodiment, wherein the cast body is illustrated in section.

Heat from the electronic power components 40 is transmitted into the base body 32 either by direct contact with the base body 32 (see the relieved portion, labelled with the reference sign 50 in FIG. 6, in the cast body 28) or via a residual thin layer of casting compound 26 (see the relieved portion, labelled with the reference sign 52 in FIG. 6, of a power component).

The heat introduced locally from the power components 40 is transmitted over the whole surface area of the heat-conducting element 30 by virtue of the high thermal conductivity of the heat-conducting element 30. Some of the heat is emitted into the environment via the outer end side of the cast body 28, and some of the heat is emitted into the housing 12 via the support tabs 36. Relatively large amounts of heat can be effectively dissipated into the environment without there being any need for heat sinks to be provided which have to extend through the cast body 28 to the outside.

A further advantage of the heat-conducting element 30 which is electrically conductively connected to the housing 12 is that it improves the EMC properties of the pump because it serves as a shield.

Figure 7:
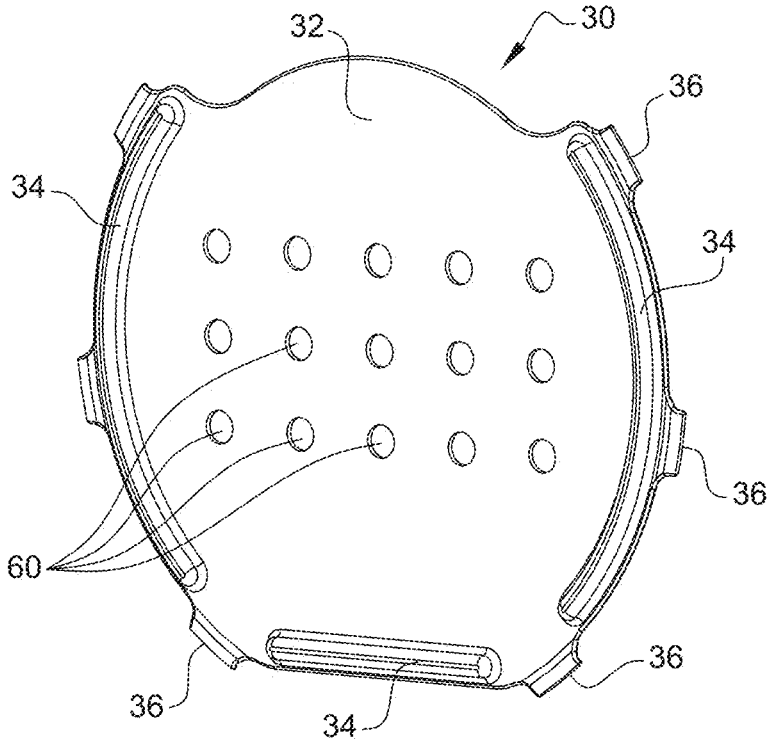
FIG. 7 shows a heat-conducting element of a fluid pump according to a second embodiment in a perspective view.
Figure 8:
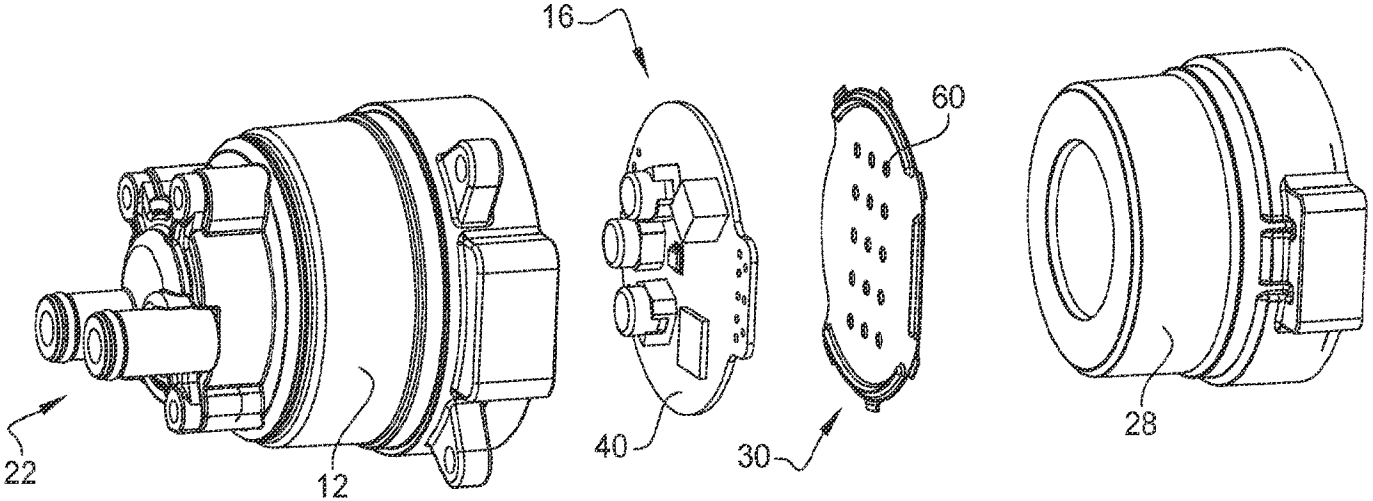
FIG. 8 shows a schematic exploded view of the fluid pump according to the second embodiment.

FIGS. 7 and 8 show a second embodiment. The same reference signs are used for the features and components known from the first embodiment, and to this extent reference is made to the explanations above.

The difference between the first and the second embodiment is that, in the second embodiment, the base body 32 is designed as not closed and instead has a plurality of perforations or through openings 60. Material bridges of casting compound extend through the through openings 60 such that those sections of the cast body 28 which are situated above and below the heat-conducting element 30 are connected directly to one another. This is advantageous for the strength of the cast body 28.

In terms of avoiding notch effects, the rims of the through openings 60 are designed as very smooth and in particular with a rounded bevel.

The invention claimed is:

1. A fluid pump, for supplying a clutch actuator, a gearbox actuator, a lubrication system and/or a cooling system of a drive train, comprising:

a housing, an electric drive unit which comprises a stator and a rotor which is arranged inside the stator and can rotate about a rotor axis, a control unit with a printed circuit board which is arranged at one end of the housing, and a heat-conducting element with a plate-like base body, wherein:

the heat-conducting element is arranged on a side of the printed circuit board which faces away from the stator, and the stator, the control unit and the plate-like base body are embedded in a casting compound.

2. The fluid pump according to claim 1, wherein the plate-like base body has a surface area which is more than 50% of an internal cross-section of the housing.

3. The fluid pump according to claim 2, wherein the plate-like base body is provided with support tabs which bear elastically against the control unit.

4. The fluid pump according to claim 2, wherein the plate-like base body bears directly against at least one electronic component of the control unit.

5. The fluid pump according to claim 2, wherein a layer of the casting compound is situated between at least one electronic component of the control unit and the plate-like base body.

6. The fluid pump according to claim 2, wherein the plate-like base body is provided with a plurality of spacers which bear against a printed circuit board of the control unit.

7. The fluid pump according to claim 2, wherein the plate-like base body is provided with a plurality of through openings.

8. The fluid pump according to claim 2, wherein the plate-like base body has at least one embossed raised/depressed portion which has a different spacing from a printed circuit board of the control unit than the remainder of the plate-like base body.

9. The fluid pump according to claim 2, wherein the plate-like base body is made from an aluminium alloy.

10. The fluid pump according to claim 2, wherein the housing is made from an aluminium alloy.

11. The fluid pump according to claim 1, wherein the plate-like base body is provided with support tabs which bear elastically against the control unit.

12. The fluid pump according to claim 11, wherein the heat-conducting element and the housing are electrically conductive.

13. The fluid pump according to claim 11, wherein the plate-like base body bears directly against at least one electronic component of the control unit.

14. The fluid pump according to claim 1, wherein the plate-like base body bears directly against at least one electronic component of the control unit.

15. The fluid pump according to claim 1, wherein a layer of the casting compound is situated between at least one electronic component of the control unit and the plate-like base body.

16. The fluid pump according to claim 1, wherein the plate-like base body is provided with a plurality of spacers which bear against the printed circuit board of the control unit.

17. The fluid pump according to claim 1, wherein the plate-like base body is provided with a plurality of through openings.

18. The fluid pump according to claim 1, wherein the plate-like base body is made from an aluminium alloy.

19. The fluid pump according to claim 1, wherein the housing is made from an aluminium alloy.

* * * * *